US006772540B2

(12) United States Patent
Delgorgue et al.

(10) Patent No.: US 6,772,540 B2
(45) Date of Patent: Aug. 10, 2004

(54) BOOT

(75) Inventors: Gerald Delgorgue, Ruffieux (FR); Catherine Fellouhe, Vieugy (FR); Thierry Donnadieu, Poisy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/023,987

(22) Filed: Dec. 21, 2001

(65) Prior Publication Data

US 2002/0139008 A1 Oct. 3, 2002

(30) Foreign Application Priority Data

Dec. 22, 2000 (FR) ..... 00 17126

(51) Int. Cl.[7] ..... A43B 5/04; A43B 7/14; A43C 11/00

(52) U.S. Cl. ..... 36/50.5; 36/50.1; 36/88; 36/92

(58) Field of Search ..... 36/4, 50.1, 50.5, 36/88, 92, 45, 69

(56) References Cited

U.S. PATENT DOCUMENTS

| | | | | | |
|---|---|---|---|---|---|
| 318,949 | A | * | 6/1885 | Brown | 36/4 |
| 2,306,306 | A | * | 12/1942 | Ferrettie | 36/4 |
| 3,798,804 | A | * | 3/1974 | Funck | 36/72 R |
| 4,447,967 | A | * | 5/1984 | Zaino | 36/45 |
| 5,317,820 | A | | 6/1994 | Bell et al. | 36/89 |
| 5,379,530 | A | | 1/1995 | Bell et al. | 36/89 |
| 5,477,593 | A | | 12/1995 | Leick | 24/712.5 |
| 5,499,459 | A | * | 3/1996 | Tomaro | 36/10 |
| 5,647,150 | A | * | 7/1997 | Romanato et al. | 36/117.1 |
| 5,678,329 | A | * | 10/1997 | Griffin et al. | 36/50.1 |
| 5,704,138 | A | * | 1/1998 | Donnadieu | 36/58.5 |
| 5,727,271 | A | * | 3/1998 | Romanato et al. | 12/142 RS |
| 5,732,483 | A | | 3/1998 | Cagliari | 36/115 |
| 5,899,006 | A | | 5/1999 | Donnadieu | 36/97 |
| 5,940,990 | A | * | 8/1999 | Barret | 36/55 |
| 5,946,827 | A | | 9/1999 | Okajima | 36/58.5 |
| 5,950,335 | A | | 9/1999 | Okajima | 36/115 |
| 5,966,841 | A | * | 10/1999 | Barret | 36/50.1 |
| 6,076,285 | A | * | 6/2000 | Caeran et al. | 36/115 |

FOREIGN PATENT DOCUMENTS

| | | |
|---|---|---|
| EP | 0753268 | 1/1997 |
| EP | 0754413 | 1/1997 |
| FR | 2706743 | 12/1994 |
| FR | 2743989 | 8/1997 |
| GB | 393508 | 6/1933 |
| WO | WO 94/04051 | 3/1994 |

* cited by examiner

*Primary Examiner*—M. D. Patterson
(74) *Attorney, Agent, or Firm*—Greenblum & Bernstein, P.L.C.

(57) ABSTRACT

A boot that includes a sole and an outer upper having an impervious portion, with at least one outer reinforcing element assembled to the upper by cementing at least in the impervious portion thereof. Preferably, the reinforcing element includes a heel reinforcement and lateral tightening flaps.

39 Claims, 4 Drawing Sheets

143
144

142
140
114
120
126
160
118
119
113
111
141
110
115
150
117
121
116
112
121
130

BOOT

CROSS-REFERENCE TO RELATED APPLICATION

This application is based upon French Patent Application No. 00 17126, filed on Dec. 22, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to an at least partially impervious boot construction adapted in particular for use in winter.

2. Description of Background and Relevant Information

Various methods are known for making a shoe impervious, i.e., impervious to water penetration. They include, for example, providing an inner liner made of a breathable and impervious material; but this construction is costly because the breathable and impervious material is very expensive and all the seams must be made impervious by sealing joints added by gluing.

Another method is to immerse the finished boot into a latex or PVC bath, up to the desired level of imperviousness. This construction is also expensive to implement, because it requires a very long processing time and costly investments.

SUMMARY OF THE INVENTION

An object of the present invention is to propose a boot whose construction is simple and cost advantageous, while having the desired characteristics, especially in terms of comfort, heat, imperviousness.

This object is achieved in the present invention due to the fact that the boot includes a sole, an outer upper having an impervious portion, and an outer reinforcing element assembled to the upper by cementing, at least in the impervious portion thereof.

Indeed, the fact that the outer reinforcement is cemented and not sewn, as in the usual boot constructions, generally makes it possible to preserve the imperviousness of the boot and to avoid the use of expensive means to seal the seams which would have been generated.

BRIEF DESCRIPTION OF DRAWINGS

The invention will be better understood from the description that follows, with reference to the annexed schematic drawings showing, by way of a non-limiting example, a preferred embodiment, and in which.

DETAILED DESCRIPTION OF THE INVENTION

Figure 1:
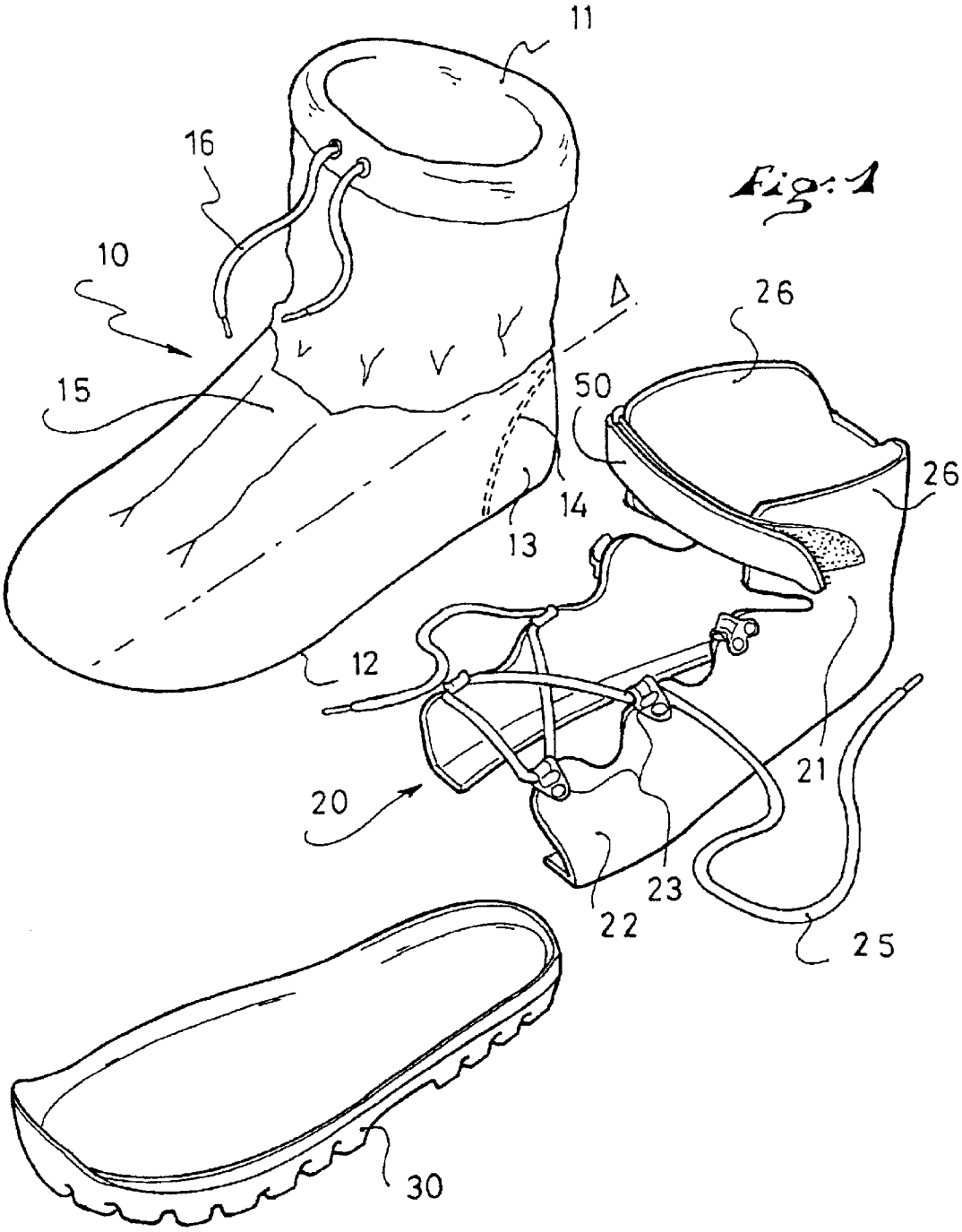
FIG. 1 is an exploded perspective view of the outer upper of the boot before assembly.

As shown in FIG. 1, the boot according to the invention includes:

an outer sole 30;

a flexible upper closed in the form of a boot, i.e., a high upper 10 having a single opening 11 at its upper end, the upper 10 being made of a flexible and impervious material, especially leather or a coated fabric, and is closed at its lower end by a sole 12, especially made of PVC;

a reinforcement 20 including a rear portion, or heel reinforcement, 21 surrounding the heel, and two lateral flaps 22 connected to the rear reinforcement 21 and covering the upper 10 of the boot, from the outer sole 30 up to the instep 15 of the upper;

wherein each lateral flap 22 has keepers 23 at its upper end, which are adapted to receive a lace 25 for tightening the outer upper 10 of the boot in the instep zone.

In the illustrated embodiments, including that shown in FIG. 1, the reinforcement 20 has a front end that is located intermediate the ends of the boot, whereby the lateral flaps 22 are spaced from the front end of the boot.

Preferably, the reinforcement 20 is a polymeric material, such as flexible polyurethane, and has various stiffening zones depending on the desired effect. Thus, the reinforcement 20 is thicker in its rear portion 21 to ensure a good nesting and a good retention/protection of the heel. The heel reinforcement 21 and tightening flaps 22 assembly is also preferably molded to shape in order to obtain an adaptation to the foot and an optimum tightening.

According to a preferred construction, the reinforcement assembly 20/21/22 is assembled on the outer upper 10 by cementing, in a cementing zone extending from the outer sole 30 up to at least an upper cementing limit Δ extending substantially to mid-height of the upper. The cement is preferably a polyurethane-base cement.

This construction makes it possible to:

guarantee the imperviousness of the boot, because it requires a minimum number of stitched seams, which are always detrimental to a good imperviousness;

simplify the construction as much as possible and, therefore, to reduce the cost proportionately, because the entire outer upper is flexible and the only stiffening/tightening means are located on a single element, namely the reinforcement/tightening flap assembly, and because the fixing of the reinforcement assembly 20/21/22 by cementing, instead of the conventional stitched seams, avoids the use of costly sealing techniques;

still obtain an efficient tightening, which is generally not the case in a high boot-type construction, because the upper ends of the tightening flaps are free in relation to the upper;

dissociate the aspects of imperviousness, provided by the outer upper, and of comfort/heat, provided by the inner liner.

If necessary, the flexible upper 11 itself can be provided with a heel stiffener 13 assembled to the upper by a seam 14; in this case, the seam 14 is covered and made impervious by the reinforcement 21/tightening flaps 22 assembly, and is therefore completely protected from the outside, since the cementing of the reinforcement assembly 20/21/22 extends up to the cementing line Δ and, therefore, above the seam 14. In this case, the stiffness of the outer heel reinforcement 21 is adapted to that of the inner heel stiffener 13.

Depending on the height of the boot, complementary tightening means can be provided in the area of the ankle/lower leg. In this case, these tightening means are constituted by a strap 50 provided with Velcro-type self-gripping means adapted to bring the two wings 26 of a vertical extension of the reinforcement 21 closer together by forming a collar around the lower part of the leg. In any event, the only means 25, 50 for tightening the boot around the foot are located on the reinforcement portion 20 of the outer upper 10. A closure means, in this case a lace 16, can also be provided to close the opening 11 of the upper 10 and avoid any penetration of water, snow, etc., inside the latter. The inner liner 40 can have any construction.

Preferably, the inner liner 40 is detachable, so that it can be easily cleaned and dried, for example.

Advantageously, the liner is provided, at its lower end, with a preferably cemented thick sole 41 corresponding to a through middle, so-called cup, of a conventional outer sole.

This sole 41 is made of a shock-absorbing material such as a PU, EVA foam.

Providing this sole 41 on the liner, and therefore within the boot, has numerous advantages:

- the sole 41 is kept warm inside the boot, and does not harden when cold, which would have the effect of eliminating the shock absorbing characteristics thereof, and the boot therefore remains comfortable regardless of the outside conditions;
- the sole 41 integrates a so-called ΔH height difference between the heel and the front zone of the foot, and therefore makes it easier to walk with the liner alone;
- the sole/liner subassembly is inserted inside the outer upper and is therefore completely detachable;
- the overall product has excellent characteristics of comfort, shock absorption, heat, and imperviousness, at a particularly advantageous cost.

Figure 4:
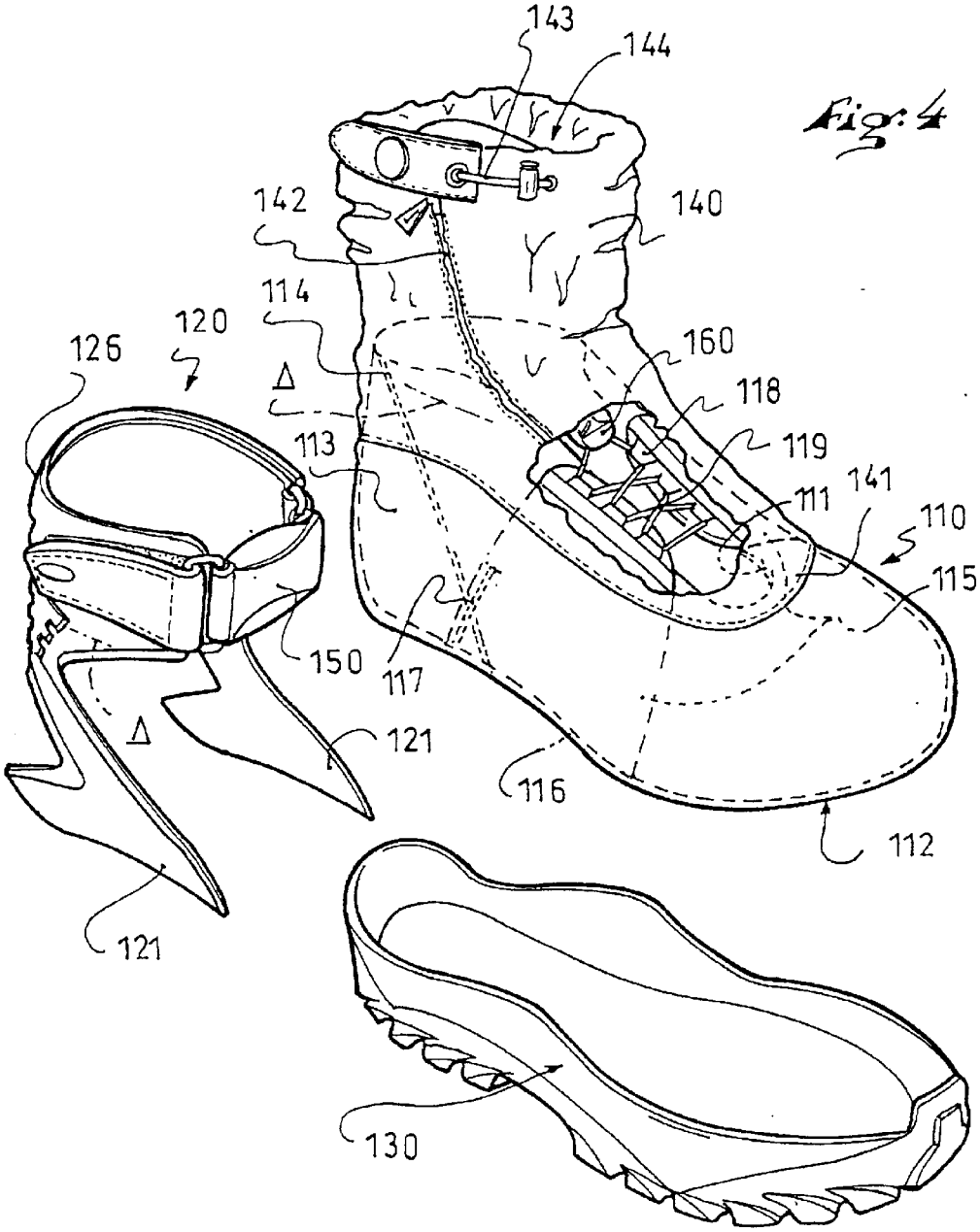
FIG. 4 is a view, similar to FIG. 1, of the outer upper of a boot according to a second embodiment.

The embodiment of FIG. 4 essentially distinguishes over the preceding embodiment in that the tightening means are essentially arranged within the boot.

This boot is composed of:

- an outer sole 130;
- a mid-height upper 110 made of an impervious material such as a coated fabric, provided at its upper end with a wide opening 111 and at its lower end with a sole 112, and having, in the heel zone, a heel stiffener 113 assembled to the upper by seams 114;
- an impervious gaiter 140 sewn at 141 along the opening 111 of the upper and rising along the leg of the user, the gaiter 140 being provided with a longitudinal lateral opening closed by a zipper 142 and with a rope 143 for tightening its upper opening 144;
- a reinforcement 120 including a rear portion or heel reinforcement having two arms 121 laterally covering the heel zone of the mid-height upper 110, and extending upwardly by joining one another to form a collar 126 surrounding the upper portion of the upper 141 and the gaiter 140, the collar 126 being provided with Velcro-type tightening means 150 or the like.

Figure 2:
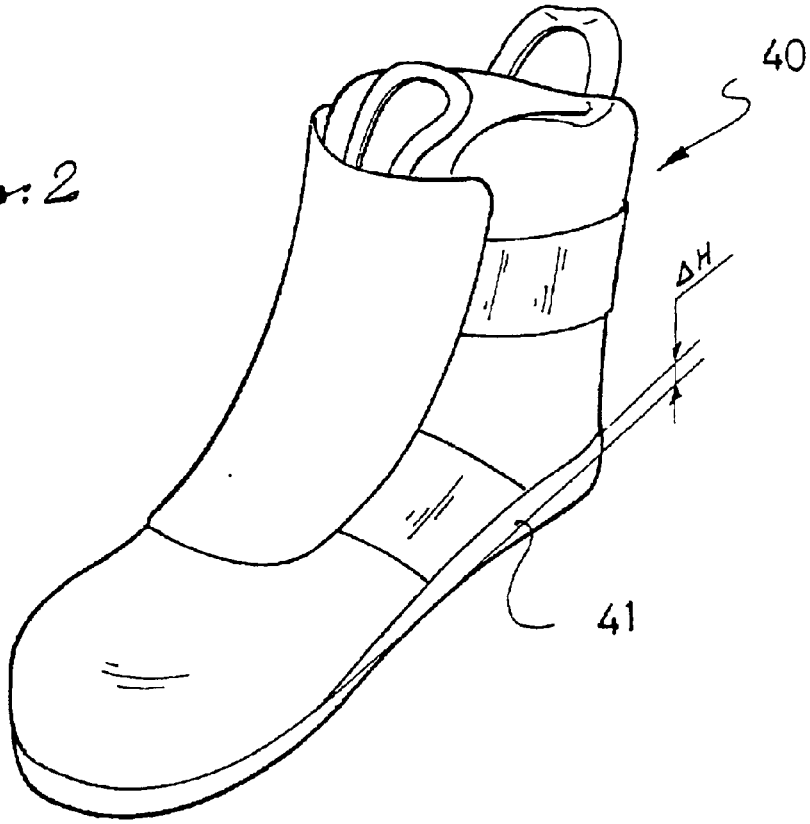
FIG. 2 is a view of the liner.
Figure 3:
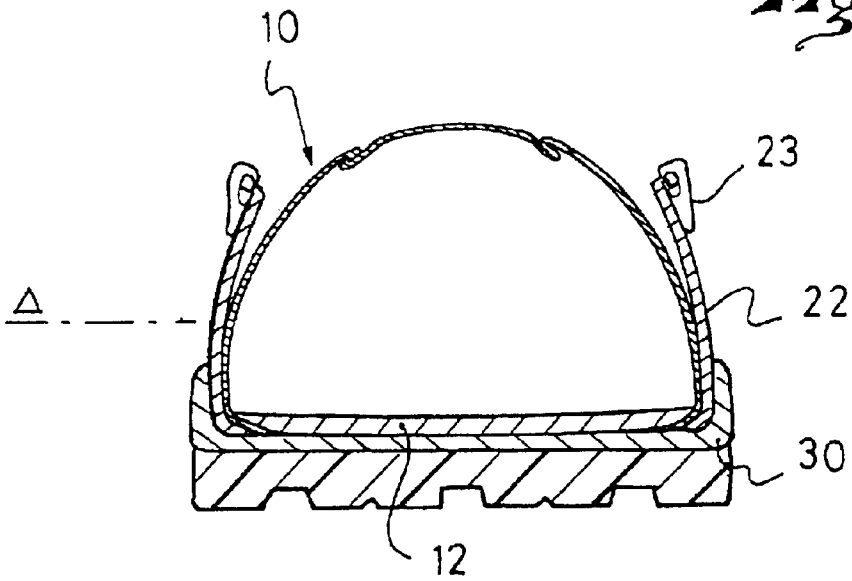
FIG. 3 is a transverse cross-sectional view of the assembled boot, without the liner.

A detachable liner (not shown in the drawing), similar to the liner 40 of FIG. 2, is adapted to be inserted within the upper to provide comfort and the desired characteristics of thermal insulation and shock absorption.

The mid-height upper 110 is further provided with an inner tightening system constituted of two flexible flaps 115, respectively medial and lateral, extending in the instep zone of the boot. These two flaps 115 are fixed at their lower end 116 to the upper 110 and to the sole 130, in particular in the common assembly zone 112 of the latter called the lasting allowance.

These two flaps 115 are further fixed to the upper 110 in their rear zone by a seam 117. The role of the seams 117 is to reinforce the linkage of the flaps to the upper, on the one hand, and to facilitate the positioning of the liner; the flaps 115 fixed in their rear zone do not hinder its insertion.

The tightening flaps 115 are provided at their free upper end with keepers 118 receiving a lace 119 for tightening the user's foot inside the upper 110. The lace 119 can be closed by a knot, or by a blocking system 160 as known from the French Patent No. 2,706,743.

As in the preceding example, the upper reinforcement 120 is fixed to the upper 110 of the boot up to mid-height of the latter, i.e., from the outer sole 130 up to the upper cementing limit Δ.

As previously mentioned, the form of the upper reinforcement 120 is provided so as to cover and to seal, by its cementing, all of the seams 117, 114 of the upper 110 located in an impervious portion thereof.

As a result, the only seams left to be made impervious are those 141 connecting the gaiter to the upper, these seams being made impervious in a known fashion by an application of cement or of an impervious film on the inner side of the upper 110.

Whether in the embodiment of FIG. 1 or of FIG. 4, the cementing of the outer reinforcement 20, 120 on the upper over a large surface of this reinforcement makes it possible, due to a simple and inexpensive construction, to guarantee a good imperviousness of the boot while, surprisingly, being sufficiently resistant to withstand the forces, especially the tensile forces exerted on the reinforcement during the tightening of at least its upper portion 50, 150.

Figure 5:
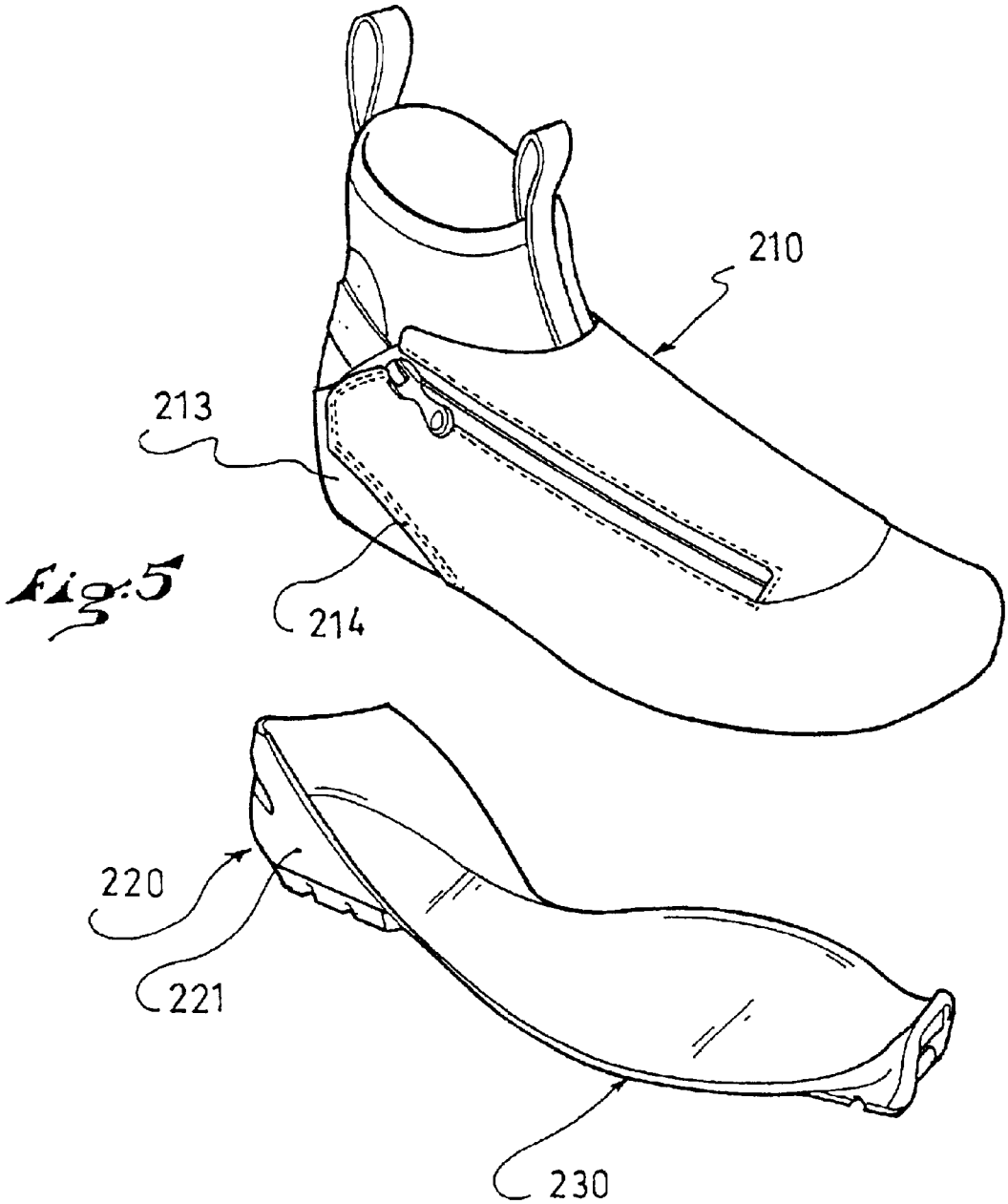
FIG. 5 is a view, similar to FIG. 1, of a boot according to a third embodiment.

In the embodiment shown in FIG. 5, the boot is composed of an outer sole 230, a mid-height upper 210 including, at the rear, a heel stiffener 213 assembled to the upper 210 by seams 214, the upper 210 covering the heel stiffener 213 from the outside.

As in the preceding embodiments, a supplemental reinforcement 220 including a heel zone 221 is cemented at the rear on the heel stiffener 213, covering the seams 214 for assembling the stiffener to the upper, thus obtaining their imperviousness.

The only difference of this embodiment with respect to the preceding embodiments is that the reinforcement 220 is affixed to the outer sole 230, and is therefore cemented to the upper concurrently with the latter.

In this case, the reinforcement 220 is made of the same material as the outer sole 230. The sole 230 can also be obtained in two portions, namely a rigid and substantially non-flexible rear portion which is then affixed to the reinforcement 220, and a more flexible front portion, as described in the document FR 2 743 989.

The present invention is not limited to the embodiments described hereinabove, by way of non-limiting examples, but encompasses all similar or equivalent embodiments.

What is claimed is:

1. A boot comprising:

a sole;

an outer upper comprising an impervious portion; and at least one outer reinforcing element, distinct of the sole, assembled to the upper with cement at least in the impervious portion of the upper;

the at least one outer reinforcing element comprising a pair of laterally spaced apart tightening flaps;

each of the tightening flaps having a free end.

2. A boot according to claim 1, wherein the at least one reinforcing element comprises a heel reinforcement.

3. A boot according to claim 2, wherein the heel reinforcement is extended on each side of the outer upper by the lateral tightening flaps.

4. A boot according to claim 2, wherein the heel reinforcement comprises a vertical extension forming a collar for tightening a lower leg of a wearer of the boot.

5. A boot according to claim 4, wherein the collar and the lateral tightening flaps comprise the only means for tightening the upper.

6. A boot according to claim 1, further comprising at least one outer seam in said impervious portion of said upper, said at least one outer reinforcing element covering and being cemented to said at least one outer seam.

7. A boot according to claim 6, wherein the outer reinforcing element comprises a heel reinforcement, said heel reinforcement covering seams of a heel stiffener of the upper.

8. A boot according to claim 7, wherein the heel reinforcement is affixed on at least one portion of the outer sole.

9. A boot according to claim 6, wherein said outer reinforcing element is assembled to said upper only by application of said cement.

10. A boot according to claim 6, wherein at least said impervious portion of said outer upper comprises a coating for effecting imperviousness.

11. A boot according to claim 6, wherein all outer stitched seams in said impervious portion of said upper including said at least one outer seam, are covered by said at least one outer reinforcing element.

12. A boot according to claim 6, wherein said tightening flaps have respective forward ends spaced from a front end of the boot.

13. A boot according to claim 1, further comprising a detachable liner provided with a sole made of a shock-absorbing material.

14. A boot according to claim 13, wherein at least said impervious portion of said outer upper comprises a coating for effecting imperviousness.

15. A boot according to claim 1, wherein the lateral tightening flaps extend rearwardly on each side of the outer upper to a heel reinforcement, and wherein the heel reinforcement comprises a vertical extension forming a collar for tightening a lower leg of a wearer of the boot.

16. A boot according to claim 15, wherein the collar and the lateral tightening flaps comprise the only means for tightening the upper.

17. A boot according to claim 1, wherein said impervious portion of said outer upper extends downwardly to said sole.

18. A boot according to claim 1, wherein at least said impervious portion of said outer upper comprises a coating for effecting imperviousness.

19. A boot comprising:

a sole;

an outer upper comprising an impervious portion; and at least one outer reinforcing element including a heel reinforcement having a vertical extension forming a collar for tightening a lower leg of a wearer of the boot;

said outer reinforcing element being assembled to the upper with cement at least in the impervious portion of the upper, the outer reinforcing element comprising lateral tightening flaps, each of the flaps having a free end;

the collar and the lateral tightening flaps comprising the only means for tightening the upper.

20. A boot comprising:

a sole;

an outer upper comprising an impervious portion, said outer upper comprising at least one outer stitched seam;

said outer upper comprising added parts covering at least said one outer stitched seam, including at least one outer reinforcing element assembled to the upper with cement at least in the impervious portion of the upper;

said outer reinforcing element comprising a pair of laterally spaced apart tightening flaps;

each of said tightening flaps having a free upper end; and each of said tightening flaps having a forward end spaced from a front end of the boot.

21. A boot according to claim 20, wherein at least said impervious portion of said outer upper comprises a coating for effecting imperviousness.

22. A boot according to claim 20, wherein all outer stitched seams in said impervious portion of said upper, including said at least one outer seam, are covered by said added parts.

23. A boot according to claim 20, further comprising a detachable liner positioned within said outer upper, said liner being provided with a sole.

24. A boot according to claim 20, wherein said impervious portion of said outer upper extends downwardly to said sole.

25. A boot according to claim 20, wherein said outer reinforcing element is assembled to said upper only by application of said cement.

26. A boot comprising:

a sole;

an outer upper comprising plurality of parts, said outer upper including an impervious portion;

securely assembling together said plurality of parts of said outer upper only by application of cement, including securely assembling at least one outer reinforcing element to said upper with cement at least in said impervious portion of said upper;

said outer reinforcing element comprising a pair of laterally spaced apart tightening flaps;

each of said tightening flaps having a free upper end; and each of said tightening flaps having a forward end spaced from a front end of the boot.

27. A boot according to claim 26, wherein, above said sole, the boot includes no stitched seams.

28. A boot according to claim 26, wherein said cement is located in a cementing zone extending from said sole to substantially mid-height of said outer upper.

29. A boot according to claim 26, wherein at least said impervious portion of said outer upper comprises a coating for effecting imperviousness.

30. A boot according to claim 26, further comprising a detachable liner positioned within said outer upper, said liner being provided with a sole.

31. A boot comprising:

a sole;

an outer upper comprising an impervious portion, said impervious portion comprising at least one outer stitched seam;

at least one outer reinforcing element assembled to said outer upper with cement at least in said impervious portion of the upper, each of said at least one outer stitched seam being covered by a cemented reinforcing element;

a tightening mechanism to tighten the boot around a foot of a wearer;

said reinforcing element comprising laterally spaced apart tightening flaps, each of said tightening flags having a free end, said tightening flaps comprising a part of said tightening mechanism, said tightening mechanism comprising the only means for adjustably tightening the upper around a foot of a wearer.

32. A boot according to claim 31, wherein all outer stitched seams in said impervious portion of said upper, including said at least one outer seam, are covered by said added parts.

33. A boot according to claim 31, wherein said impervious portion of said outer upper extends downwardly to said sole.

34. A boot comprising:

an external sole, an outer upper, and an outer reinforcing element;

said sole comprising a lowermost external wear surface;

said outer upper comprising an impervious portion; and said outer reinforcing element being assembled to the upper with cement at least in the impervious portion of the upper;

said outer reinforcing element comprising a pair of laterally spaced apart tightening flaps, each of said tightening flaps having a free end, said tightening flaps having respective forward ends spaced from a front end of the boot.

35. A boot according to claim 34, wherein said tightening flaps are laterally spaced apart above an instep area of the boot.

36. A boot according to claim 35, wherein said tightening flaps are part of a tightening mechanism, said tightening mechanism further comprising a lacing connecting together said spaced apart tightening flaps.

37. A boot according to claim 34, wherein said cement extends from said sole to an upper cementing limit substantially mid-height of said outer upper.

38. A boot according to claim 34, further comprising a detachable liner positioned within said outer upper, said liner being provided with a sole.

39. A boot according to claim 34, wherein said external sole, said outer upper, and said outer reinforcing element constitute three distinct parts of the boot.

* * * * *